US010259625B2

(12) United States Patent
Reckley

(10) Patent No.: US 10,259,625 B2
(45) Date of Patent: Apr. 16, 2019

(54) COLD SHOT SERVING APPARATUS

(71) Applicant: Michael Reckley, Indianopolis, IN (US)

(72) Inventor: Michael Reckley, Indianopolis, IN (US)

( * ) Notice: Subject to any disclaimer, the term of this patent is extended or adjusted under 35 U.S.C. 154(b) by 178 days.

(21) Appl. No.: 14/625,580

(22) Filed: Feb. 18, 2015

(65) Prior Publication Data

US 2015/0230641 A1 Aug. 20, 2015

Related U.S. Application Data

(60) Provisional application No. 61/941,351, filed on Feb. 18, 2014.

(51) Int. Cl.

| | |
|---|---|
| ***F25D 3/08*** | (2006.01) |
| ***B65D 47/26*** | (2006.01) |
| ***F25D 31/00*** | (2006.01) |

(52) U.S. Cl.

CPC ..... *B65D 47/26* (2013.01); *F25D 3/08* (2013.01); *F25D 31/007* (2013.01); *F25D 2303/0846* (2013.01); *F25D 2331/803* (2013.01)

(58) Field of Classification Search

CPC ..... A47G 23/0241; F25D 2303/0841; F25D 2303/084; F25D 2331/803; F25D 2303/0846; F25D 31/007; F25D 3/08

See application file for complete search history.

(56) References Cited

U.S. PATENT DOCUMENTS

| | | | | | |
|---|---|---|---|---|---|
| 1,428,591 | A * | 9/1922 | Holland | F25D 25/027 | 62/265 |
| 1,489,754 | A * | 4/1924 | Fruen | F25D 3/08 | 222/184 |
| 1,616,085 | A * | 2/1927 | Heath | F25D 25/00 | 312/116 |
| 2,090,403 | A * | 8/1937 | Murray | B67D 1/04 | 222/183 |
| 4,793,514 | A * | 12/1988 | Sheets | B67D 3/0032 | 137/433 |
| 5,222,631 | A * | 6/1993 | Hood | B67D 1/0835 | 222/131 |
| 5,862,937 | A * | 1/1999 | Carrizales | F25D 31/007 | 206/5 |
| 6,112,537 | A * | 9/2000 | Broadbent | B65D 25/08 | 62/293 |
| 7,182,222 | B2 * | 2/2007 | Prabucki | B67D 1/0869 | 222/146.1 |
| 8,684,205 | B2 * | 4/2014 | Meager | B65D 25/42 | 215/307 |
| 8,770,441 | B2 * | 7/2014 | Macler | B65D 33/01 | 222/85 |

(Continued)

FOREIGN PATENT DOCUMENTS

| | | | | |
|---|---|---|---|---|
| EP | 2196752 A1 * | 6/2010 | F25D 5/02 | |
| GB | 2113074 A * | 8/1983 | A47G 23/0241 | |

*Primary Examiner* — Filip Zec

(74) *Attorney, Agent, or Firm* — Patent Service Associates; Lyman Smith

(57) ABSTRACT

A non-electric cold shot serving apparatus is designed to hold any type of bottle and be able to serve it cold, without any electricity being supplied to the unit. The cold shot serving apparatus is both portable and lightweight and can be used anywhere. The device can fit virtually any size bottle of beverage, such as wine, spirits, or the like, in its original container, and chill it for service regardless of location.

20 Claims, 6 Drawing Sheets

(56) References Cited

U.S. PATENT DOCUMENTS

| | | | | |
|---|---|---|---|---|
| 8,919,611 | B2 * | 12/2014 | Ophardt | A47K 5/1207 222/181.3 |
| 9,120,663 | B2 * | 9/2015 | Macler | B65D 33/01 |
| 2009/0126394 | A1 * | 5/2009 | Krog | F25D 3/08 62/399 |
| 2011/0240680 | A1 * | 10/2011 | Ophardt | A47K 5/1207 222/321.8 |

* cited by examiner

COLD SHOT SERVING APPARATUS

CROSS-REFERENCE TO RELATED APPLICATIONS

This application claims the benefit of priority of provisional patent application No. 61/941,351, filed Feb. 18, 2014, the contents of which are herein incorporated by reference.

BACKGROUND OF THE INVENTION

The present invention relates to the alcoholic and non-alcoholic beverage industry and more specifically, to both on-premise (bar/restaurant accessories) and off-premise tasting of beverages in club stores, grocery stores, drug stores, package liquor stores, and the like, as well as for apparatus for serving of beverages with a non-electric cold shot serving device.

For serving for serving wine/spirits cold shots, bartenders often keep a bottle in the freezer or on ice with beer bottles, for example. This can be inconvenient or may result in shot contamination due to ice and/or water running from the bottle into the shot glass.

Some bartenders may use an electric cold shot serving apparatus. These apparatus are often stationary and are positioned where they cannot be moved easily. Moreover, these apparatus are expensive, require additional maintenance, and could become gummed up easily. The electric cold shot serving apparatus can breakdown often due to the number of internal parts, such as condensers, coils, and other electrical functions within the unit.

As can be seen, there is a need for an improved cold shot serving apparatus.

SUMMARY OF THE INVENTION

In one aspect of the present invention, a cold shot serving apparatus comprises an ice reservoir having an open top and a base; a raised portion in the base for receiving an open end of a bottle; a fluid delivery tube communicating fluid from the bottle to an exterior of the ice reservoir; one or more holes formed in the base of the ice reservoir; and a base member supporting the ice reservoir and receiving melted ice from the ice reservoir via the one or more holes.

In another aspect of the present invention, a cold shot serving apparatus comprises an ice reservoir having an open top and a base; a raised portion in the base for receiving an open end of a bottle; a fluid delivery tube communicating fluid from the bottle to an exterior of the ice reservoir; one or more holes formed in the base of the ice reservoir; a base member supporting the ice reservoir and receiving melted ice from the ice reservoir via the one or more holes; an adaptor fitting into the raised portion and fitting onto the open end of the bottle; and an air tube communicating air from the base member to an inside of the bottle.

In a further aspect of the present invention, a cold shot serving apparatus comprises an ice reservoir having an open top and a base; a raised portion in the base for receiving an open end of a bottle; a fluid delivery tube communicating fluid from the bottle to an exterior of the ice reservoir; one or more holes formed in the base of the ice reservoir; a base member supporting the ice reservoir and receiving melted ice from the ice reservoir via the one or more holes; an air tube communicating air from the base member to an inside of the bottle; a lip disposed about a top portion of the base member, the lip catching condensate formed on the ice reservoir as the condensate drains toward the base member; and one or more condensate drain holes permitting fluid to drain from the lip into the base member.

These and other features, aspects and advantages of the present invention will become better understood with reference to the following drawings, description and claims.

DETAILED DESCRIPTION OF THE INVENTION

Figure 1:
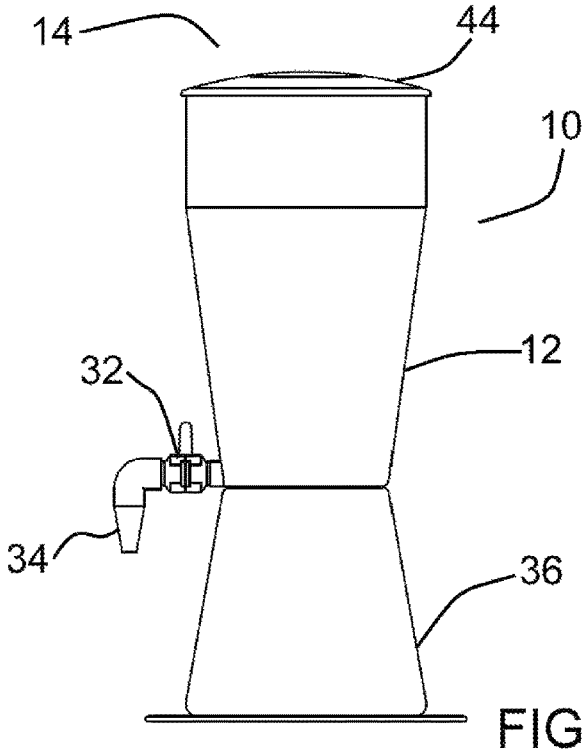
FIG. 1 is a side view of a chill tower/cold shot serving apparatus according to an exemplary embodiment of the present invention.
Figure 2:
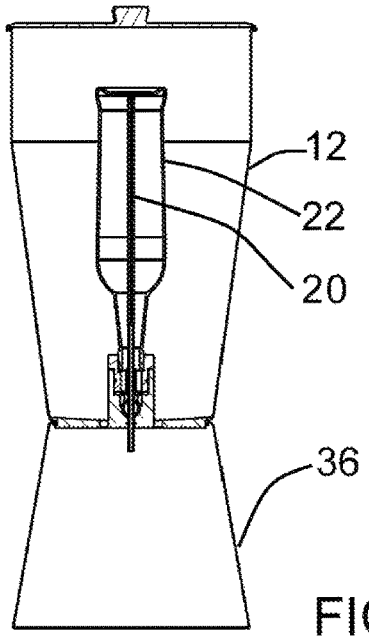
FIG. 2 is a partially cut away front view of the chill tower of FIG. 1, illustrating a bottle disposed therewithin.
Figure 3:
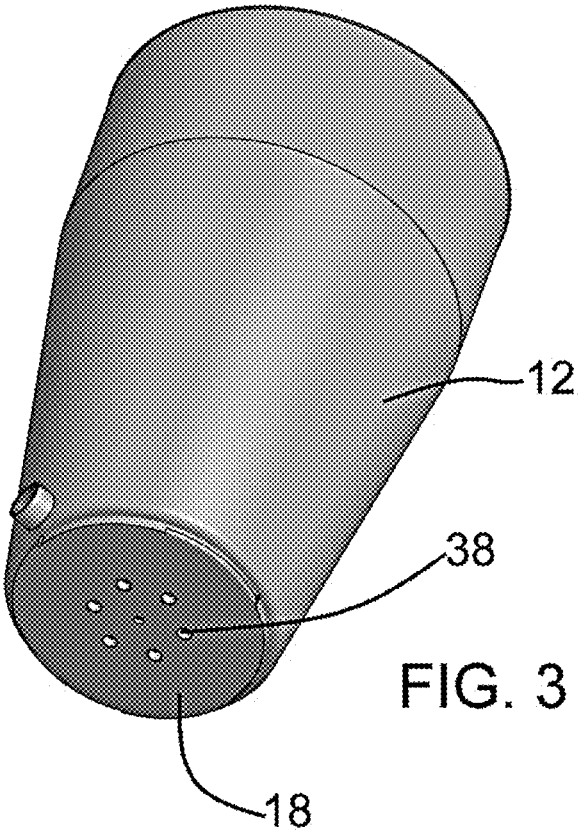
FIG. 3 is a bottom perspective view of an ice reservoir of the chill tower of FIG. 1.
Figure 4:
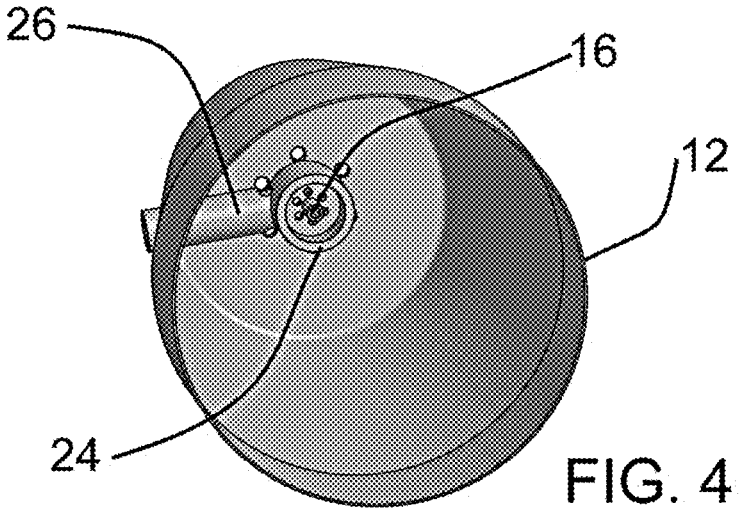
FIG. 4 is a top perspective view of the ice reservoir of FIG. 3.
Figure 5:
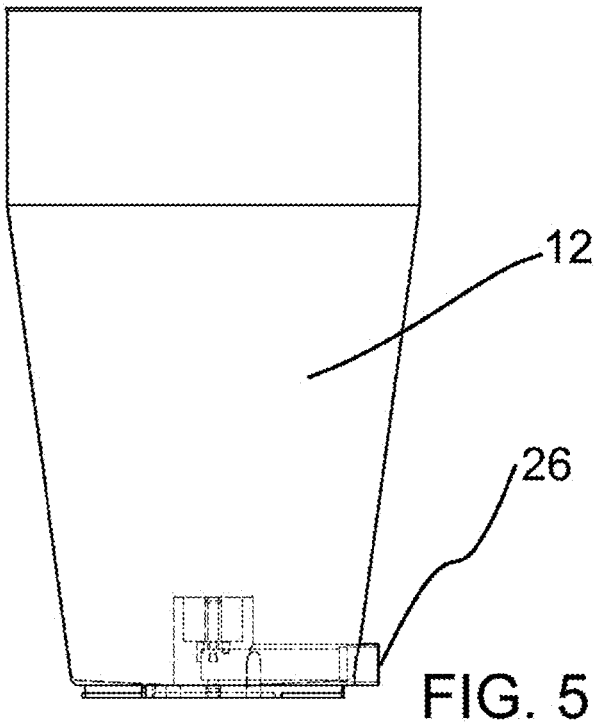
FIG. 5 is a side view of the ice reservoir of FIG. 3.
Figure 6:
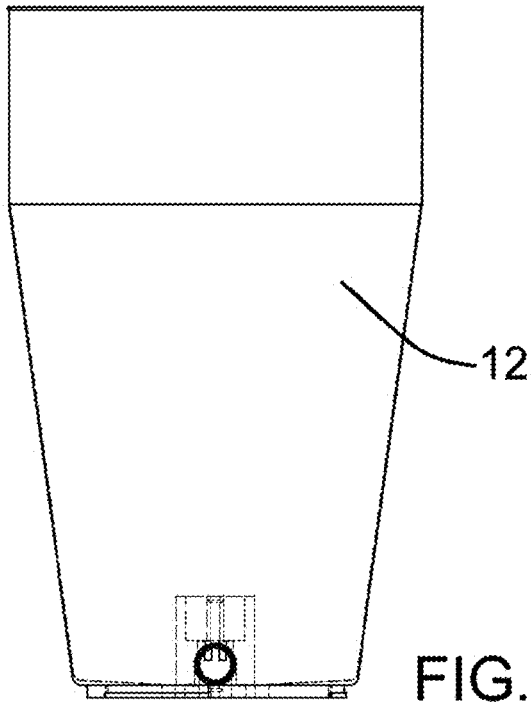
FIG. 6 is a front view of the ice reservoir of FIG. 3.
Figure 7:
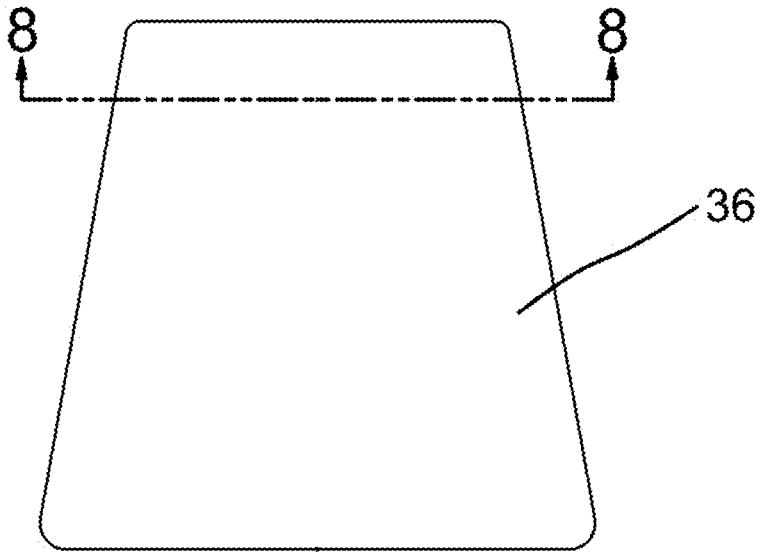
FIG. 7 is a side view of a base member/melted ice reservoir of the chill tower of FIG. 1.
Figure 8:
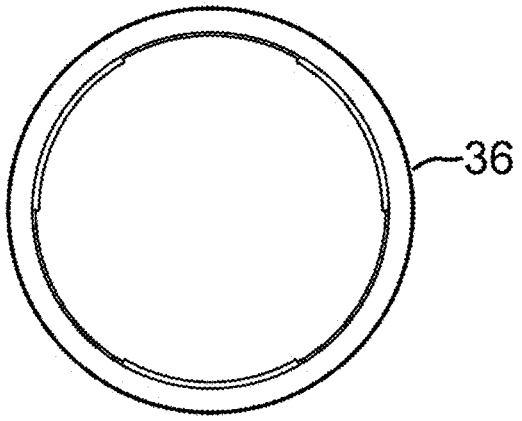
FIG. 8 is a cross-sectional view taken along line 8-8 of FIG. 7.
Figure 9:
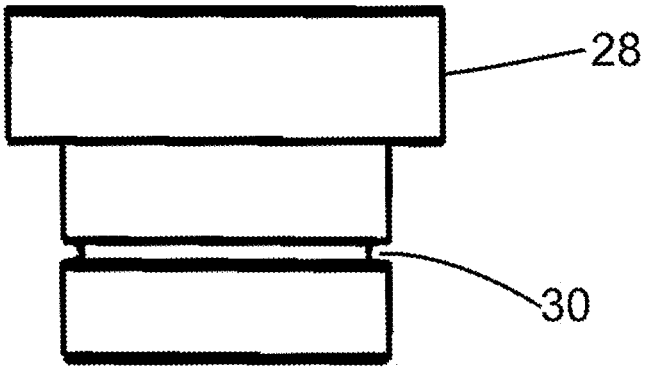
FIG. 9 is a side view of an adaptor used to mount a bottle in the chill tower of FIG. 1.
Figure 10:
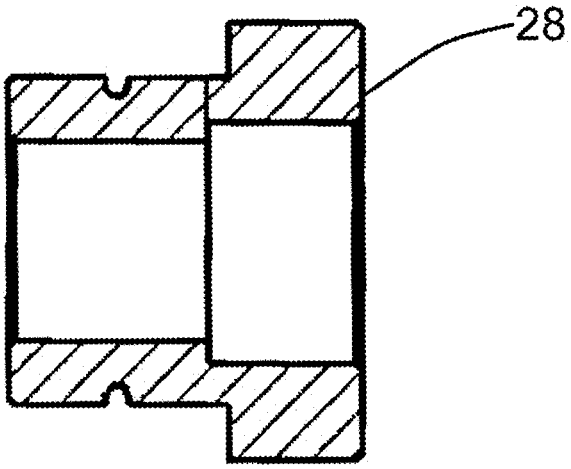
FIG. 10 is a cross-sectional view of the adaptor of FIG. 9.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a non-electric cold shot serving apparatus that is designed to hold any type of bottle and be able to serve it cold, without any electricity being supplied to the unit. The device of the present invention is both portable and lightweight and can be used anywhere. The device can fit virtually any size bottle of adult beverage, in its original container, and chill it for service regardless of location.

Referring now to FIG. 1 through 10, a cold shot serving apparatus 10 (also referred to as a chill tower 10) can be made of three distinct elements that can be formed separately and joined together, molded as a single piece or some combination thereof. The first element at the top of the cold shot serving apparatus is an ice reservoir 12, having an open top 14 and designed, for example, as an upside-down frusto-conical shaped ice container. A lid 44 may be used to cover the open top 14 while in use. The ice reservoir 12 can have with a raised center hole 16 disposed in its base 18. The hole 16 can have a raised edge extending up from the base 18. A tubing 20 may extend upward (see FIG. 2) from this hole 16. The hole 16 may communicate air from below the base 18 of the ice reservoir 12 to a top portion of a bottle 22 disposed in the chill tower 10. As fluid is removed from the bottle 22, the fluid may flow smoothly without creating a vacuum in a top portion of the bottle 22. Other mechanisms, as may be understood in the art, may be used to communicate air into a top of the bottle as fluid is removed therefrom.

A raised chamber 24 having a predetermined diameter may be disposed on the base 18 of the ice reservoir 12. The raised chamber 24 may communicate with a fluid delivery tube 26 that may extend along the base 18 to an exterior of the ice reservoir 12. The raised chamber 24 can receive fluid from the bottle 22 and deliver that fluid, via the fluid delivery tube 26, to the outside of the ice reservoir 12. In some embodiments, the fluid delivery tube 26 may be disposed within the ice reservoir 12 to ensure cold shots being delivered to the user. However, in some embodiments, the fluid delivery tube 26 may be disposed below the base 18 of the ice reservoir 12.

An adaptor 28 may be used to connect the raised chamber 24 with the bottle 22. The adaptor 28 may include a groove 30 for disposing an o-ring (not shown) to create a seal between the adaptor 28 and the raised chamber 24, thereby preventing the beverage from escaping into the ice reservoir 12. Other mechanisms may be used to interconnect the adaptor 28 to the raised chamber 24. In some embodiments, the adaptor 28 may be made integrally into the base 18 of the ice reservoir 12. This embodiment may be useful when the device is designed for use with only a single type of beverage bottle. In other embodiments, with the use of different sizes of the adaptor 28, the chill tower 10 may be used with various sizes and shapes of bottles 22.

The fluid delivery tube 26 may terminate with a connector, such as threads, for attachment of a valve 32. The valve 32 may be of various types, such as a gate valve, a toggle valve, or the like. In some embodiments, the valve 32 may be an auto-off valve, such as those found on water coolers, thereby preventing the chill tower 10 from delivering the beverage without direct user control. The valve 32 may terminate with a delivery spout 34, which may be sized and shaped according to the user's requirements, provided that fluid from the bottle 22 may be delivered through the valve and out of the delivery spout 34.

The ice reservoir 12 may rest on a base member 36. The base member 36 may be made from various materials and may be formed in various sizes and shapes, provided that is supports the ice reservoir 12. Drain holes 38 in the base 18 of the ice reservoir 12 may allow melted ice to drain from the ice reservoir 12 into the base member 36. In some embodiments, the base member may be designed as a hollow, water containing member, where the base member 36 can be drained as needed. In some embodiment, a drain port (not shown) may be disposed in the base member 36 to allow it to continuously drain water from the melted ice.

In one embodiment, the ice reservoir 12 can have an open top about 10-14 inches in diameter and about 12 to 16 inches high. The open top can angle down to a base 18 that is from about 6 to 8 inches in diameter.

The base member 26 can be sized to permit ample space for water from molten ice to accumulate. In one embodiment, the base can be frusto conical, having a top meeting with the base 18 of the ice reservoir 12. The sides of the base member 26 can be angled outward as they extend from about 4 to about 6 inches to a base that is from about 6 to about 10 inches in diameter, for example.

Figure 11:
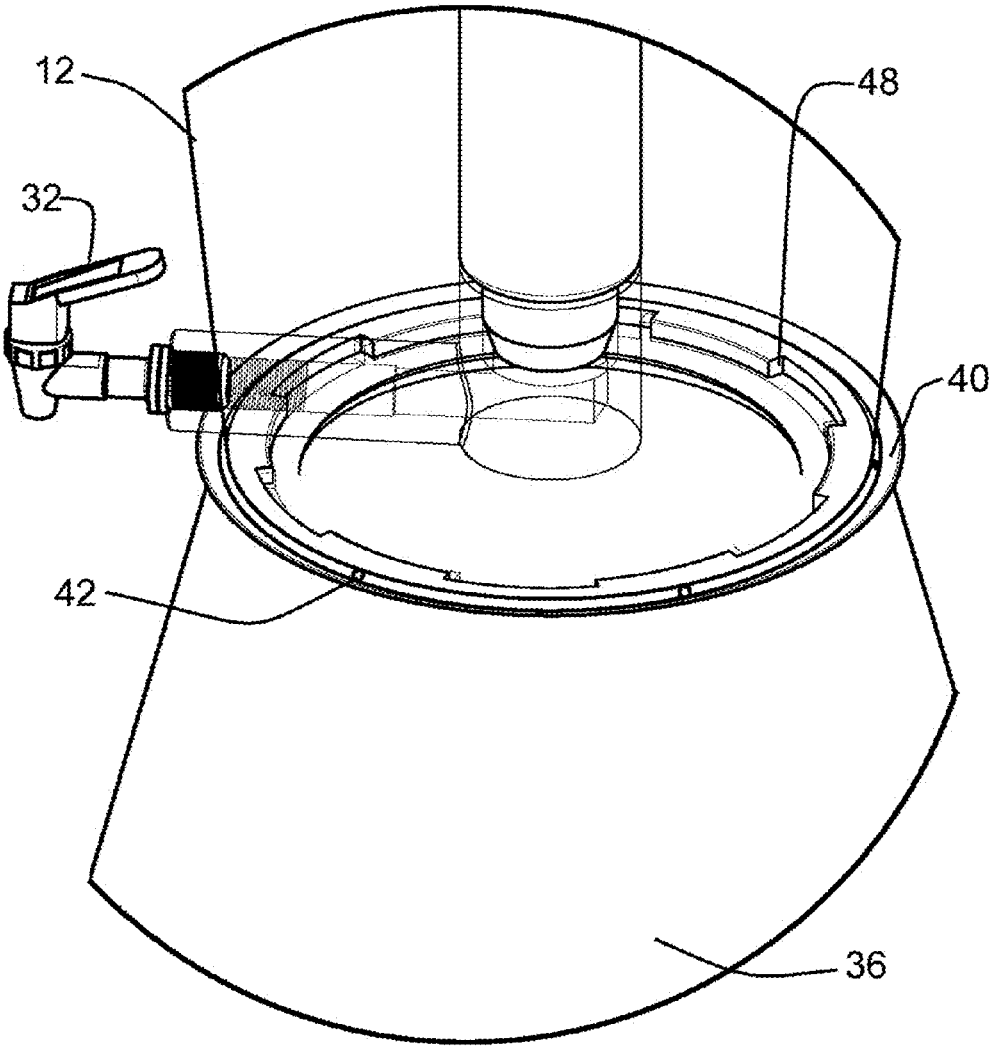
FIG. 11 is a perspective view of a chill tower according to an alternate embodiment of the present invention.

In some embodiments, as shown in FIG. 11, the base member 36 may be formed with a lip 40 that extends about the top of the base member 36. The lip 40 may be sized larger than the base 18 of the ice reservoir 12. In this embodiment, condensation from the ice reservoir 12 may be contained by the lip 40. A plurality of lip drain holes 42 may be disposed about the base member 36 to permit condensate running down the sides of the ice reservoir 12 and into the lip 40 may drain into the base member 36.

The ice reservoir 12 can attach to the base member 26 by various mechanisms. In some embodiments, the ice reservoir 12 may simply set upon the base member 26. In other embodiments, as shown in FIG. 11, a set of notches and protrusions 46 may be disposed below the base 18 of the ice reservoir 12. These notches and protrusions 46 can align with mating notches and protrusions (not shown) in the top side of the base member 26. A user may simply align the notches and protrusions 46 of the ice reservoir 12 to the base member 36 and twist one of the ice reservoir 12 or the base member 36 to provide a secure connection therebetween. Of course, other connection mechanisms may be utilized to secure the base member 36 to the ice reservoir. In some embodiments, such as those where a drain plug is provided in the base member 36, the base member may be integral with the ice reservoir, providing a one-piece design.

The chill tower 10 can be made of various materials. Typically, the device can be made of a clear acrylic, typically about ⅜ inch thick. This allows the user to see the ice and the bottle disposed in the middle of the ice in the ice container. Special effects can be easily added, such as adding small portions of dry ice to the ice container to provide a smoking appearance.

In some embodiments, to use the device, a user can place the adaptor on the bottle. The adaptor is designed to fit into the raised portion in the base of the ice reservoir. The adaptor can help prevent possible leaks from the ice reservoir. The bottle can then be placed into the raised portion in the base of the ice reservoir. In other embodiments, the adaptor can be fixed inside the raised portion and the bottle can form a seal with the adaptor when the bottle is inserted in the adaptor.

Ice can be added to the ice reservoir and the result is a portable and easy to use and maintain device that can dispense wine or spirit cold shots therefrom. The device can be used behind a bar or could be used for table bottle service, where a table can be provided with the device for dispensing wine or spirit cold shots. As the ice melts, additional ice can simply be added. If the base fills with water, the device can be moved over a drain and the drain plug can be removed to rapidly drain water and allow the unit to be used continuously.

The device of the present invention could be used for off premise accounts for all types of products, both alcoholic and non-alcoholic.

It should be understood, of course, that the foregoing relates to exemplary embodiments of the invention and that modifications may be made without departing from the spirit and scope of the invention as set forth in the following claims.

What is claimed is:

1. A cold shot serving apparatus comprising:

an ice reservoir having an open top and a base;

a raised portion extending from the base for receiving an open end of a bottle;

a fluid delivery tube communicating fluid from the bottle to an exterior of the ice reservoir;

an adaptor formed as a tubular member having a first end fitting into the raised portion and a second end communicating with the first end and receiving the open end of the bottle, the adaptor creating a sealed fluid communication between the bottle and the second end of the adaptor and between the raised portion and the first end of the adaptor to prevent liquid from the bottle from escaping into the ice reservoir;

one or more holes formed in the base of the ice reservoir; and a base member supporting the ice reservoir and receiving melted ice from the ice reservoir via the one or more holes.

2. The cold shot serving apparatus of claim 1, further comprising a valve located on the fluid delivery tube.

3. The cold shot serving apparatus of claim 1, further comprising a spout located at an end of the fluid delivery tube.

4. The cold shot serving apparatus of claim 1, further comprising a lip disposed about a top portion of the base member, the lip catching condensate formed on the ice reservoir as the condensate drains toward the base member.

5. The cold shot serving apparatus of claim 4, further comprising one or more condensate drain holes permitting fluid to drain from the lip into the base member.

6. The cold shot serving apparatus of claim 1, wherein the fluid delivery tube is disposed within the ice reservoir.

7. The cold shot serving apparatus of claim 1, wherein the bottle extends into a first side of the adaptor without extending out of a second side of the adaptor.

8. The cold shot serving apparatus of claim 1, wherein the first end of the adaptor has a first outer diameter and the second end of the adaptor has a second outer diameter greater than the first outer diameter.

9. A cold shot serving apparatus comprising:

an ice reservoir having an open top and a base;

a raised portion extending from the base for receiving an open end of a bottle;

a fluid delivery tube communicating fluid from the bottle to an exterior of the ice reservoir;

one or more holes formed in the base of the ice reservoir;

a base member supporting the ice reservoir and receiving melted ice from the ice reservoir via the one or more holes; and an adaptor formed as a tubular member having a first end fitting into the raised portion and a second end communicating with the first end and receiving the open end of the bottle, the adaptor creating a sealed fluid communication between the bottle and the second end of the adaptor and between the raised portion and the first end of the adaptor to prevent liquid from the bottle from escaping into the ice reservoir.

10. The cold shot serving apparatus of claim 9, further comprising a valve located on the fluid delivery tube.

11. The cold shot serving apparatus of claim 9, further comprising a spout located at an end of the fluid delivery tube.

12. The cold shot serving apparatus of claim 9, further comprising a lip disposed about a top portion of the base member, the lip catching condensate formed on the ice reservoir as the condensate drains toward the base member.

13. The cold shot serving apparatus of claim 12, further comprising one or more condensate drain holes permitting fluid to drain from the lip into the base member.

14. The cold shot serving apparatus of claim 9, wherein the bottle extends into a first side of the adaptor without extending out of a second side of the adaptor.

15. The cold shot serving apparatus of claim 9, wherein the first end of the adaptor has a first outer diameter and the second end of the adaptor has a second outer diameter greater than the first outer diameter.

16. A cold shot serving apparatus comprising:

an ice reservoir having an open top and a base;

a raised portion extending from the base for receiving an open end of a bottle;

a fluid delivery tube communicating fluid from the bottle to an exterior of the ice reservoir;

one or more holes formed in the base of the ice reservoir;

a base member supporting the ice reservoir and receiving melted ice from the ice reservoir via the one or more holes;

an adaptor formed as a tubular member having a first end fitting into the raised portion and a second end communicating with the first end and receiving the open end of the bottle, the adaptor creating a sealed fluid communication between the bottle and the second end of the adaptor and between the raised portion and the first end of the adaptor to prevent liquid from the bottle from escaping into the ice reservoir;

a lip disposed about a top portion of the base member, the lip catching condensate formed on the ice reservoir as the condensate drains toward the base member; and one or more condensate drain holes permitting to drain from the lip into the base member.

17. The cold shot serving apparatus of claim 16, further comprising a valve located on the fluid delivery tube.

18. The cold shot serving apparatus of claim 16, further comprising a spout located at an end of the fluid delivery tube.

19. The cold shot serving apparatus of claim 16, wherein the bottle extends into a first side of the adaptor without extending out of a second side of the adaptor.

20. The cold shot serving apparatus of claim 16, wherein the first end of the adaptor has a first outer diameter and the second end of the adaptor has a second outer diameter greater than the first outer diameter.

* * * * *